US006336007B1

(12) United States Patent
Sugisaki et al.

(10) Patent No.: US 6,336,007 B1
(45) **Date of Patent: *Jan. 1, 2002**

(54) PRINTER THAT FACILITATES DETECTION OF DETERIORATED COMPONENT

(75) Inventors: Eiichi Sugisaki, Kawasaki; Hideo Okawa, Tokyo; Yoshinori Wada, Kawasaki, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/427,924

(22) Filed: Oct. 27, 1999

(30) Foreign Application Priority Data

Feb. 3, 1999 (JP) ..... 11-026438

(51) Int. Cl.[7] ..... G03G 15/00
(52) U.S. Cl. ..... 399/11; 399/15; 399/31
(58) Field of Search ..... 399/16, 23, 31, 399/36, 37, 11, 32, 15

(56) References Cited

U.S. PATENT DOCUMENTS

| | | | | | |
|---|---|---|---|---|---|
| 4,335,952 | A | * | 6/1982 | Conly et al. | 399/11 |
| 4,785,329 | A | * | 11/1988 | Walsh | 399/11 |
| 4,821,068 | A | | 4/1989 | Honma et al. | 355/14 |
| 4,958,188 | A | | 9/1990 | Miyamoto | 355/206 |
| 5,012,279 | A | * | 4/1991 | Nakajima et al. | 399/31 |
| 5,053,815 | A | * | 10/1991 | Wendell | 399/10 |
| 5,313,253 | A | * | 5/1994 | Martin et al. | 399/16 |
| 5,335,043 | A | * | 8/1994 | Kluger et al. | 399/16 |
| 5,508,787 | A | * | 4/1996 | Hasegawa et al. | 399/31 |
| 5,619,307 | A | * | 4/1997 | Machino et al. | 399/11 |
| 5,839,013 | A | * | 11/1998 | Murasawa et al. | 399/15 |
| 5,946,521 | A | * | 8/1999 | Budnik et al. | 399/24 |

FOREIGN PATENT DOCUMENTS

| | | |
|---|---|---|
| EP | 0093242 | 11/1983 |
| EP | 0 476 681 | 3/1992 |
| EP | 0 684 526 | 11/1995 |
| EP | 0 810 484 | 12/1997 |
| EP | 0 811 890 | 12/1997 |
| JP | 56-50338 | 5/1981 |
| JP | 58-200250 | 11/1983 |
| JP | 61-198174 | 9/1986 |
| JP | 62-221572 | 9/1987 |
| JP | 1-311898 | 12/1989 |
| JP | 3-44730 | 2/1991 |
| JP | 3-73865 | 3/1991 |
| JP | 4-284465 | 10/1992 |
| JP | 5-31960 | 2/1993 |
| JP | 7-280889 | 10/1995 |

* cited by examiner

*Primary Examiner*—Robert Beatty
(74) *Attorney, Agent, or Firm*—Armstrong, Westerman, Hattori, McLeland & Naughton, LLP.

(57) ABSTRACT

An evaluation method and printer in which a maintenance man may easily identify a deteriorated component in addition to a component that is broken down or is remarkably hard to operate without the need for any additional complex detecting device. A printer has a control part which controls a mechanical part and judges quantitatively in which state among normal, deteriorated, and abnormal states each mechanical part component is located. This judgment will change in accordance with whether the printer is in a maintenance or a normal mode. Further, a deteriorated component can be determined by visually inspecting a copy after one or a combination of electric parameters have been set to printable upper and lower limits.

11 Claims, 11 Drawing Sheets

PRINTER THAT FACILITATES DETECTION OF DETERIORATED COMPONENT

BACKGROUND OF THE INVENTION

1. Field of the Invention

The present invention generally relates to judgment methods, and more particularly to a method for detecting. when an image-forming device is inspected for maintenance purposes, deterioration in each device component. The method of the present invention is suitable, for example, for maintenance inspection of an electrophotographic printing device, such as a copier.

2. Description of the Related Art

A conventional maintenance inspection for an electrophotographic printer has required a maintenance man to use a manual operation and consider each component to be normal if it is currently working, except for components that may be inspected with eyes such as toner in a transparent plastic vessel. A maintenance man would consider a component to be abnormal and exchange/repair it only when it is completely inoperable or very hard to operate. In other words, the conventional maintenance inspection has only judged whether a target component is normal or abnormal, and considered the component to be normal if judging it not to be abnormal.

The conventional maintenance inspection cannot help considering a component to be normal which is not completely normal but it has not reached the apparently abnormal state (referred to as "a deteriorated state" hereinafter). However, the subsequent continuous use of the deteriorated state is likely to bring about a near-future failure or very bad operation. Therefore, the conventional maintenance inspection would often result in inoperativeness shortly after the maintenance inspection, annoying customers. In addition, it has been disadvantageously difficult for the conventional maintenance inspection to easily judge whether a component is in the deteriorated state.

The deterioration in a printer component may disable printing in the near future as well as gradually lower the print quality. A print operation depends upon components having various print functions as a whole. One deteriorated component would possibly lower the entire print quality. However, the conventional maintenance inspection has a difficulty in quantitatively evaluating the print quality. Even a detection of the image-quality deterioration cannot easily trace the causative component.

SUMMARY OF THE INVENTION

Therefore, it is an exemplified general object of the present invention to provide a novel and useful evaluation method and printer in which the above disadvantages are eliminated.

Another exemplified and more specific object of the present invention is to provide an evaluation method and printer without additional complex detecting means that may enable a maintenance mall to easily identify a deteriorated component in addition to a component that is broken down or is remarkably hard to operate.

Still another exemplified object of the present invention is to provide an evaluation method and printer that enable a maintenance man to quantitatively evaluate the current print quality.

Another exemplified object of the present invention is to provide a judgment method and printer that may easily localize a causative component after the image quality is considered deteriorated.

In order to achieve the above objects, a printer of a first aspect of the present invention comprises a mechanical part which feeds a printing paper and in order to print predetermined information on the printing paper, a mode switch which switches plural modes, and a control part which controls the mechanical part and determines quantitatively in each mode which state among normal, deteriorated, and abnormal states each component in said mechanical part is located in.

A printer of a second aspect of the present invention comprises a photosensitive body, a pre-charger which charges the photosensitive body, an optical part which exposes the charged photosensitive body, a developer which applies a bias voltage to toner and develops the exposed photosensitive body, forming a toner image with a desired concentration, a transfer unit which transfers the toner image onto a printing paper by applying a transfer current to the printing paper, and a control part which enable printing by setting to a printable upper and lower limits one or more set values among electric parameters including a surface potential in the photosensitive body, an exposure power in the optical part, the bias voltage in the developer, and the transfer current in the transfer unit.

An evaluation method of the present invention comprises the steps of setting a mode used to test a print quality margin, setting to an upper or lower value one or more set values among electric parameters including a surface potential in said photosensitive body, an exposure power in the optical part, a bias voltage in the developer, and a transfer current in the transfer unit, printing a predetermined pattern in accordance with the set electric parameters.

Other objects and further features of the present invention will become readily apparent from the following description of the embodiments with reference to accompanying drawings.

DETAILED DESCRIPTION OF PREFERRED EMBODIMENTS

Figure 1:
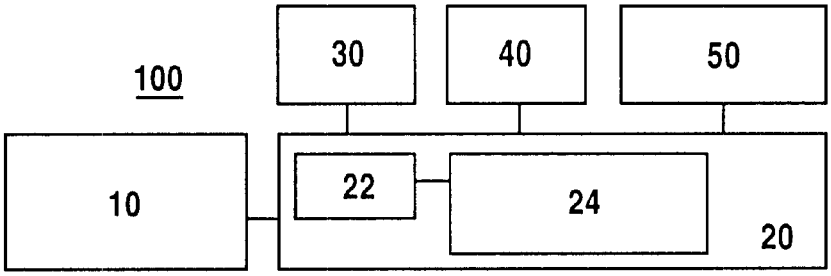
FIG. 1 is a block diagram of a printer of a first embodiment according to the present invention.

A description will now be give of printer 100 of a first embodiment according to the present invention, with reference to the accompanying drawings. Those elements in each drawing which are designated by the same reference numerals denote the same elements, and a duplicate description thereof will be omitted.

The printer 100 of the present invention includes. as shown in FIG. 1, mechanical part 10, control part 20, monde switch 30, detection level input part 40, and display part 50. FIG. 1 is a block diagram of a printer of the first embodiment according to the present invention.

The mechanical part 10 generalizes components in the printer 100, and thus includes paper feed, print, and other systems. The control part 20 controls the mechanical part 10, and includes RAM 22 and ROM 24. The RAM 22 stores a detection level entered from the detection level input part 40, and the ROM 24 stores a control program by which the control part 20 controls the mechanical part 10.

The mode switch 30 switches an operation mode of the printer 100 between a normal mode and a maintenance mode, by a manual operation or an automatic operation in accordance with a host device connected to the control part 20. In the manual input, the mode switch 30 would be equipped with an input device having various types of keys. As described later, the mode switch 30 may be comprised of display part 50 and a touch-key operation panel. The normal mode allows the printer 100 to conduct a normal operation and print predetermined information on a printing paper. The maintenance mode is used for a maintenance man to inspect each component in the printer 100. The printer 100 of the present invention displays its unique effects when the mode switch 30 is set to the maintenance mode and works similar to known printers when the mode switch 30 is set to the normal mode.

The detection level input part 40 may store detection levels corresponding to a completely normal state. a deteriorated state, and an abnormal (or unusual) state. The detection level input part 40 may be used for both the normal and maintenance modes.

The display part 50 indicates various messages to a maintenance man and an operational status of the printer 100, such as "no paper", "replace toner", etc. The display part 50 may use both the normal and maintenance modes.

Figure 2:
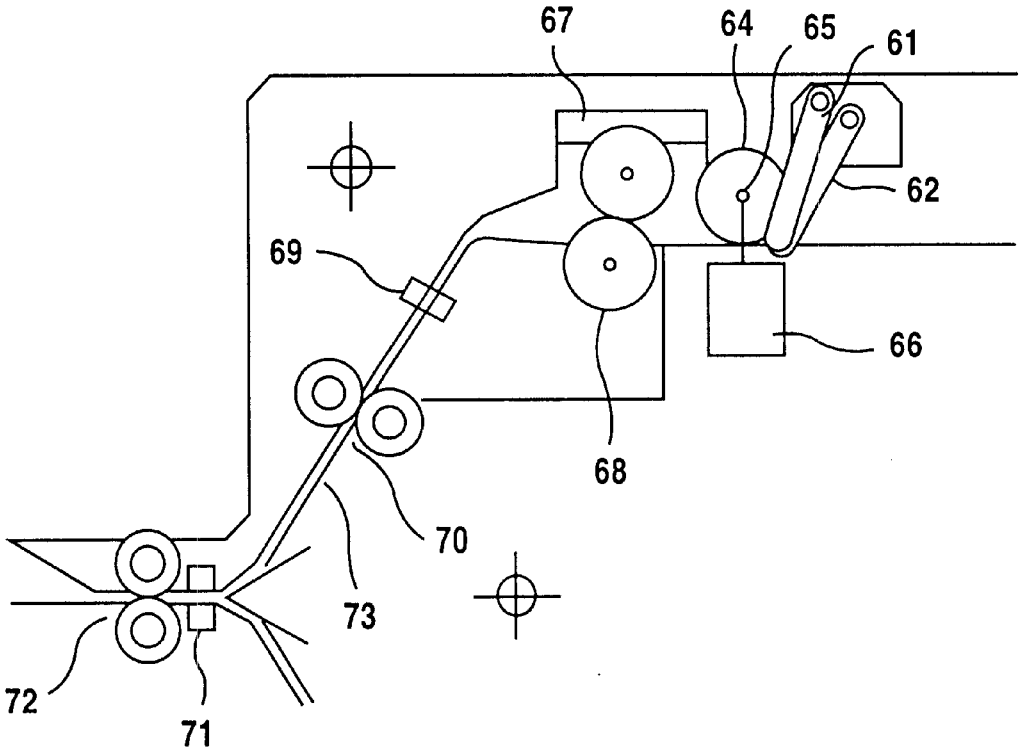
FIG. 2 is an enlarged section showing an exemplified paper feed system that is applicable to mechanical part 10 shown in FIG. 1.

With reference to FIG. 2, a description will be given of exemplified concrete components of paper feed motor 66 and paper sensor 69 in the mechanical part 10 that is applicable to the evaluation method of the present invention. FIG. 2 is an enlarged section showing the exemplified paper feed system in the mechanical part 10. As illustrated, the paper feed system in the mechanical part 10 includes height sensor 61, "no paper" detecting sensor 62, pick roller 64, paper feed motor 66, feed roller 67, reverse roller 68, paper sensors 69 and 71, central rollers 70, and eject rollers 72.

The amount of printing paper stock is detected by the height sensor 61 that detects the height of a printing paper. The "no paper" detecting sensor 62 detects that stacker 63 has no printing papers. The height sensor 61 and the "no paper" detecting sensor 62 are connected to the controller 20 shown in FIG. 1, and the display part 50 indicates the information on "no paper". However, these components are known in the art, and a description of their detailed structures and operations will be omitted.

The pick roller 64 is engaged with motor shaft 65 in the paper feed motor 66, and the paper feed motor 66 is controlled by the controller 20. The pick roller 64 serves to pick up a printing paper. Other rollers, such as the roller 67, are connected to motors (not shown) by a well-known method and controlled by the control part 20, and a detailed description of their structures and operations will be omitted.

The reverse roller 68 rotates revere to the feed roller (67, and separates, if two sheets of papers are erroneously fed, the uppermost paper from the remaining papers so as to feed this to feed path 73. The sensors 69 and 71 may each use a light-emitting element and a light-receiving element, for example. The ejected paper from the eject roller 72 is fed to the print system (not shown).

A fault associated with the pick roller 64, such as a paper jam, is detectable by measuring a paper feed period ("t1") from time when an ON signal for starting the pick roller 64 is supplied to time when the paper sensor 69 detects a paper edge, and comparing t1 with a reference value. A fault associated with the central rollers 70 at both sides of the feed path 73 is detectable by measuring a paper feed period ("t2") between the sensors 69 and 71, and comparing t2 with a reference value.

Figure 3:
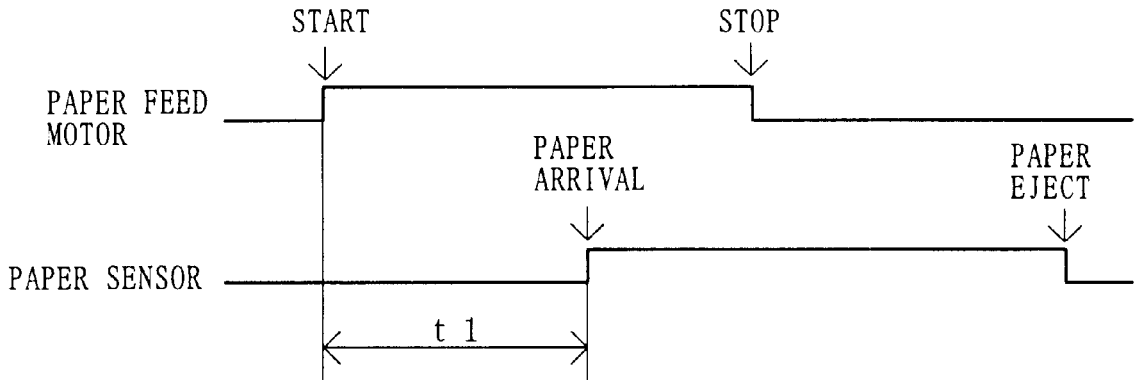
FIG. 3 is a timing chart for detecting that something is wrong with the paper feed motor shown in FIG. 2.
Figure 4:
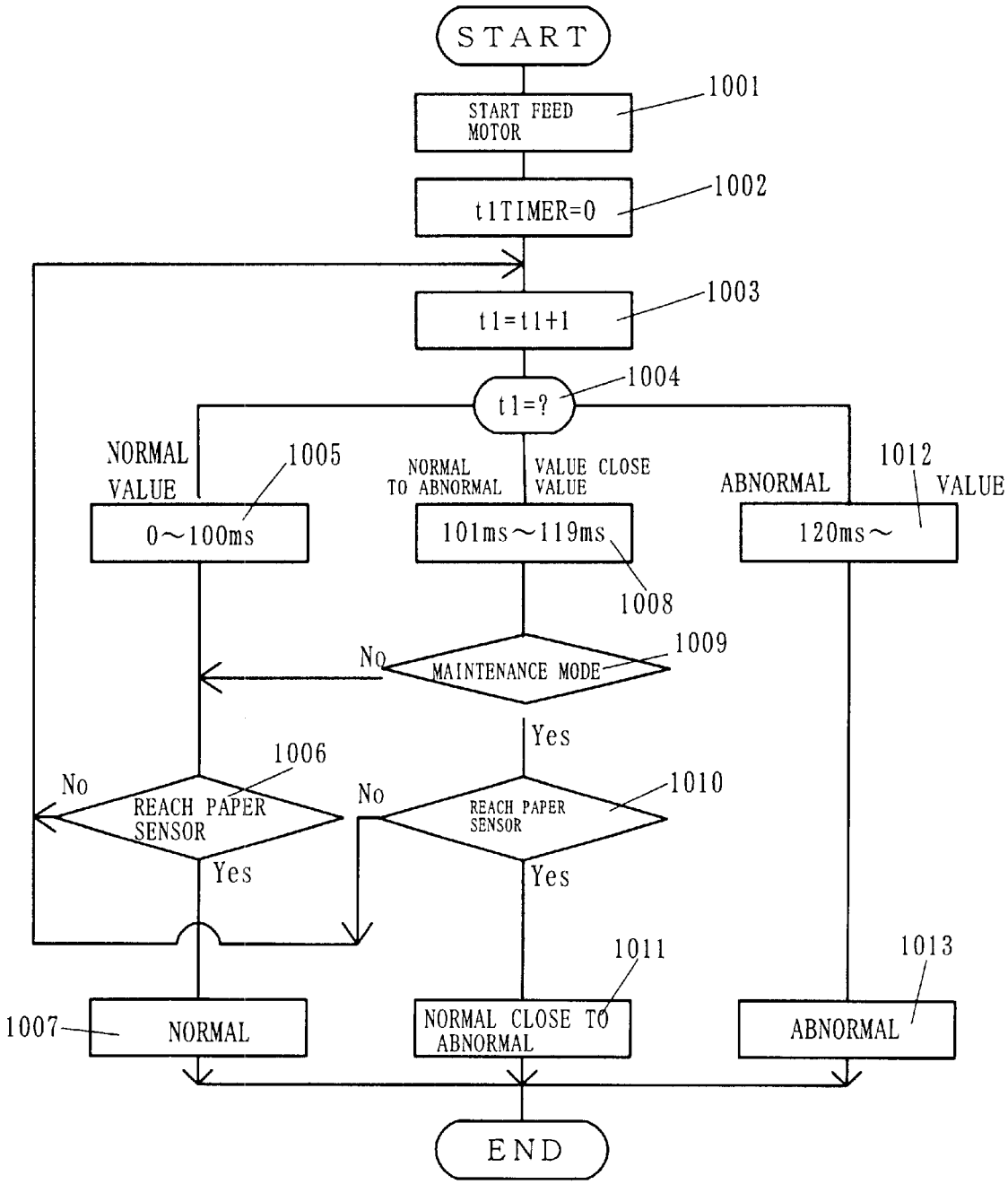
FIG. 4 is a flowchart showing an exemplified evaluation method of the present invention that is applicable to the paper feed system, shown in FIG. 2.

With reference to FIGS. 3 and 4, a description will now be given of the evaluation method of the present invention that is applied to the paper feed system. FIG. 3 is a timing chart showing the paper feed period t1. FIG. 4 is a flowchart that the controller 20 performs and is stored, for example, as a control program in the ROM 24. Alternatively, the evaluation method of the present invention may be loaded as a printer driver onto a general-purpose personal computer connected to the printer 100. In that case, the personal computer CPU may perform the following operation of the control part 20.

Advantageously, the evaluation method of the present invention classifies t1 into three groups of "normal state", "deteriorated state", and "abnormal state", and assigns "100 ms or shorter", "101 ms to 119 ms", and "120 ms or longer", to them respectively.

The control part 20 initiates the feed motor 60 by supplying a drive circuit in the feed motor 66 (not shown) with an ON signal (step 1001), and clears, by setting this time to be time 0, a timer (not shown) which measures the paper feed period t1 (step 1002). The timer is provided in the controller 20, and may employ any structure known in the art. For example, the timer includes a pulse generator that provides a pulse having a 1 ms period, and a counter that counts the number of pulses. Alternatively, the timer may use an electronic clock in a personal computer when the evaluation method of the present invention is loaded as a printer driver onto a general-purpose personal computer connected to the printer 100. The leading edge time of the feed motor 66 in FIG. 3 is the time when the ON signal is supplied. Thereby, the paper feed motor 66 picks up a printing paper and feeds it to the feed path 73. When this feeding paper reaches the sensor 69 through the feed roller 67, a detection signal of the sensor 69 is fed to the control part 20 and consequently the control part 20 may know, using the timer, the detection time by the sensor 69. The leading edge time of the paper sensor 69 in FIG. 3 is the time when the paper reaches the sensor 69.

The control part 20 thus obtains the paper feed period t1 (steps 1003 and (1004). When the paper feed period t1 is between 0 and 100 ms, it is normal. The control part 20 then considers the current operational mode to be normal whether it is set to a normal mode or a maintenance mode (steps 1006 and 1007), and will or will not display that fact and/or a value of t1 on the display part 50.

When the paper feed period t1 is between 101 and 109 ms, it is deteriorated. The control part 20 then considers the current operational mode to be normal when it is set to the normal mode (steps 1009, 1006, and 1007), and considers it to be abnormal when it is set to the maintenance mode (steps 1009, 1010, and 1011). The display part 50 indicates the resultant judgment by the control part 20.

According to this embodiment, the control part 20 considers the deteriorated stated to be normal in the normal mode. This is because in the normal mode in the instant embodiment the longer paper feed than the usual does not deteriorate the image quality and a user in general is presumed to be satisfied with the obtained result. On the contrary, the deterioration in a print system component disadvantageously lowers the image quality, as described later, and may be considered to be abnormal even in the normal mode. Optionally, the control part 20 may consider a component to be abnormal in the normal mode when the component belongs to a system other than the print system. Such setting may be preinstalled as a program in the ROM 24 in the factory before the printer 100 is shipped, or may be input by a provider as a result of conference with a customer at an initial setup when he/she provides the customer with the printer 100.

When the paper feed period t1 exceed 120 ms, it is abnormal. The control part 20 then considers the current operational mode to be abnormal (steps 1012 and 1013), and displays the fact and/or a value of t1 on the display part 50.

The control part 20 may indicate a conceivable countermeasure instead of or in addition to displaying the normality or abnormity. For example, it is a letter or symbol that recommends an adjustment of the paper feed motor 66, the paper sensor 69 and/or an engagement state between the pick roller 64 and the motor shaft 65, or that identifies a component that should be replaced. Needless to say, a deteriorated component might possibly be the sensor 69 or the like rather than tile feed motor 66.

Optionally, the control part 20 may recognize and display the deteriorated state as an independent state, instead of assigning it to the normal or abnormal state. In this case, a maintenance man may inform a customer that something will possibly be wrong with the feed motor 66 etc. in the near future, and give a spare to the customer without replacing the feed motor 66 etc. if the replacement is easy for the customer. Instead, the maintenance man leaves the conclusion to customer's decision. If the customer would like the maintenance man to come again and replace it when the breakdown occurs, the maintenance man may avoid making repairs this time. Such a measurement may take into consideration the frequency of customer's use and a deterioration level, e.g., a case where t1 is close to the normal state, such as 101 ms. Such options are common to the following embodiments.

The evaluation method of the feed system in this embodiment considers the deteriorated state to be abnormal or at least informs a customer of the deterioration, whereas the deteriorated state has been considered to be normal in the conventional maintenance mode. As a consequence, the instant evaluation method may prevent a breakdown shortly after the maintenance inspection or evade customer's disgust even if a breakdown occurs shortly after the maintenance inspection. Therefore, the evaluation method of this embodiment may improve the maintenance service.

The evaluation method of the present invention changes a detection level between the normal and maintenance modes, but does not change its operation, facilitating easy and inexpensive maintenance inspection. For example, a method that requires the maintenance mode to increase a printing-paper feed speed for a test mode needs an independent drive unit etc., making the entire device expensive. The evaluation method of the present invention eliminates such a problem.

Figure 5:
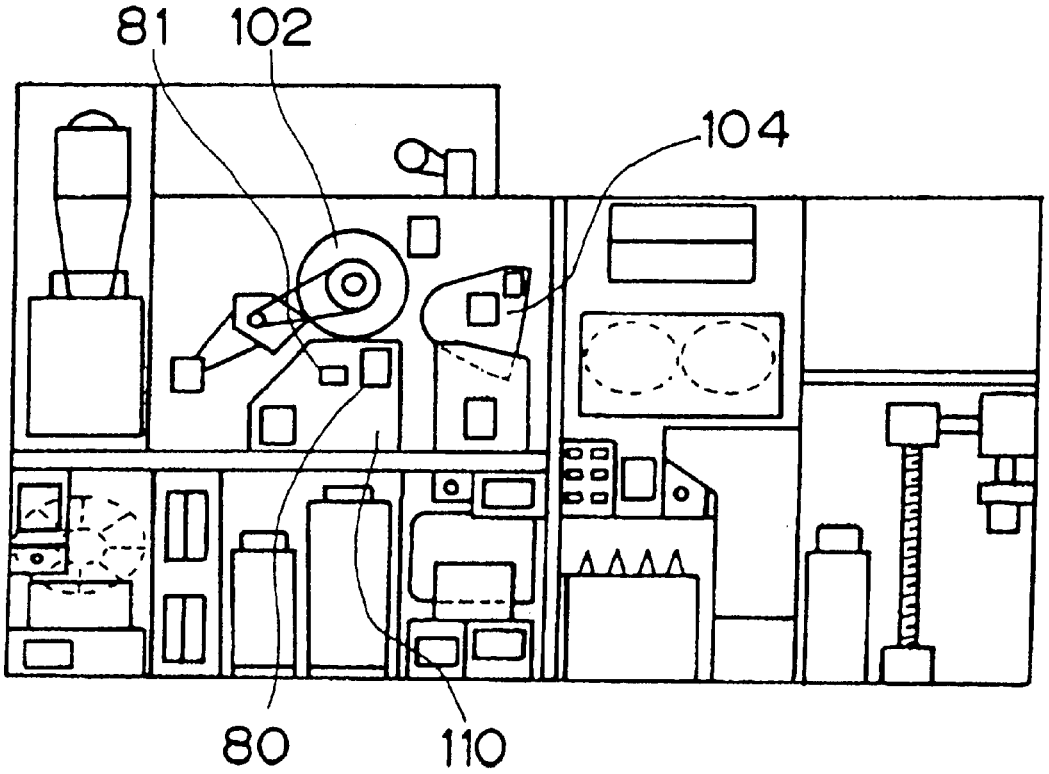
FIG. 5 is a rear view of a motor in an exemplified device applicable to the printer shown in FIG. 1.

The evaluation method of the present invention is applicable to Mg motor 80 and Mg roller rotation detector 81 when the mechanical part 10 is designed as shown in FIG. 5. The structure shown in FIG. 5 is known as a rear view of a motor in Fujitsu F6760 page printer, and a description of detailed structures and operations of components will be omitted.

Figure 6:
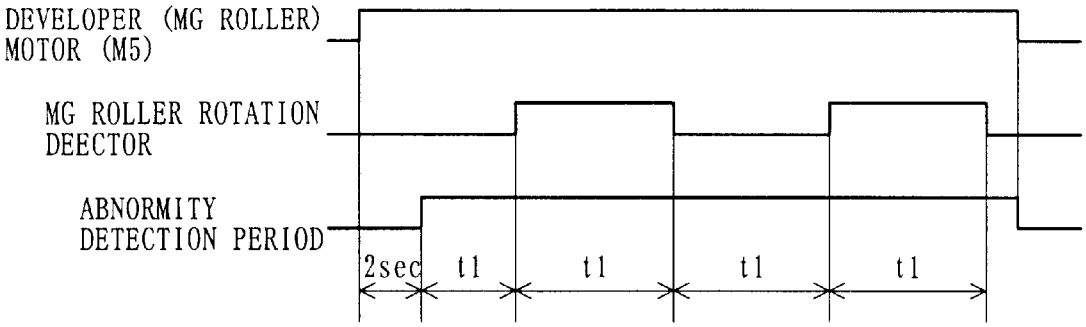
FIG. 6 is a timing chart for detecting that something is wrong with an Mg roller and/or Mg roller detector shown in FIG. 5.

The control part 20 in FIG. 5 is set so that it considers abnormal a case where 2 seconds after the developer Mg motor 80 starts no output changes from the Mg roller station detector 81 continues for 300 ms or longer. Referring to FIG. 6, according to the evaluation method of the present invention the control part 20 considers t1 to be abnormal when t1 is 300 ms or longer, and t1 to be normal when t1 is less than 300 ms. FIG. 6 is a timing chart for use with the Mg roller rotation detector 81 to detect that something is wrong with the Mg roller motor 80 and Mg roller rotation detector 81, but the timing chart is usually used to detect that something is wrong with the Mg roller motor 80. Illustrated t1 is expected to be about 150 ms in the normal state, and thus is classified into three groups of "normal state", "deteriorated state", and "abnormal state" which are assigned "shorter than 225 ms", "225 ms or longer but shorter than 300 ms", and "300 ms or longer". The control part 20 considers the deteriorated state to be normal in the normal mode, and considers it to be abnormal in the maintenance mode.

It is understood that such an evaluation method requires the step 1005 in FIG. 4 to be replaced with 0 through 224 ms, the step 1008 with 225 through 300 ms, the step 1012 with 300 ms or longer, and these steps 1006 and 1010 with output changes from the Mg roller rotation detector 81.

As described, the evaluation method of the present invention quantitatively detects, using a detector in the printer 100, which status among the normal, deteriorated and abnormal states each component is located in. The present invention is thus clearly applicable to other detectors. For example, the present invention is applicable to pinch-roller adhesion motor 82, pinch-roller UP position detector 83, separation tab set position detector 84, pinch-roller position down 1 detector 85, and pinch-roller position down 2 detector 86 shown in FIGS. 7 and 8. Hereupon, FIG. 7 is a front view of a motor in Fujitsu F6760 page printer shown in FIG. 5, and FIG. 8 is a rear view of a sensor and a photo-interrupter in the printer.

Figure 9:
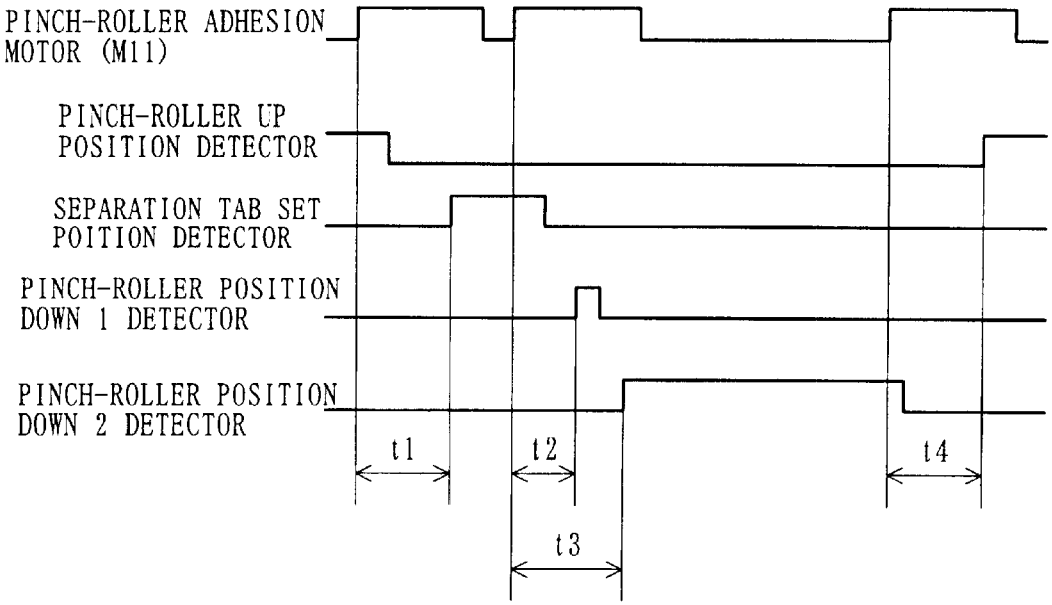
FIG. 9 is a timing chart for detecting that something is wrong with a pinch-roller adhesion motor, a pinch roller UP position detector a separation tab set position detector, a pinch-roller position down 1 detector and/or a pinch-roller position down 2 detector.
Figure 7:
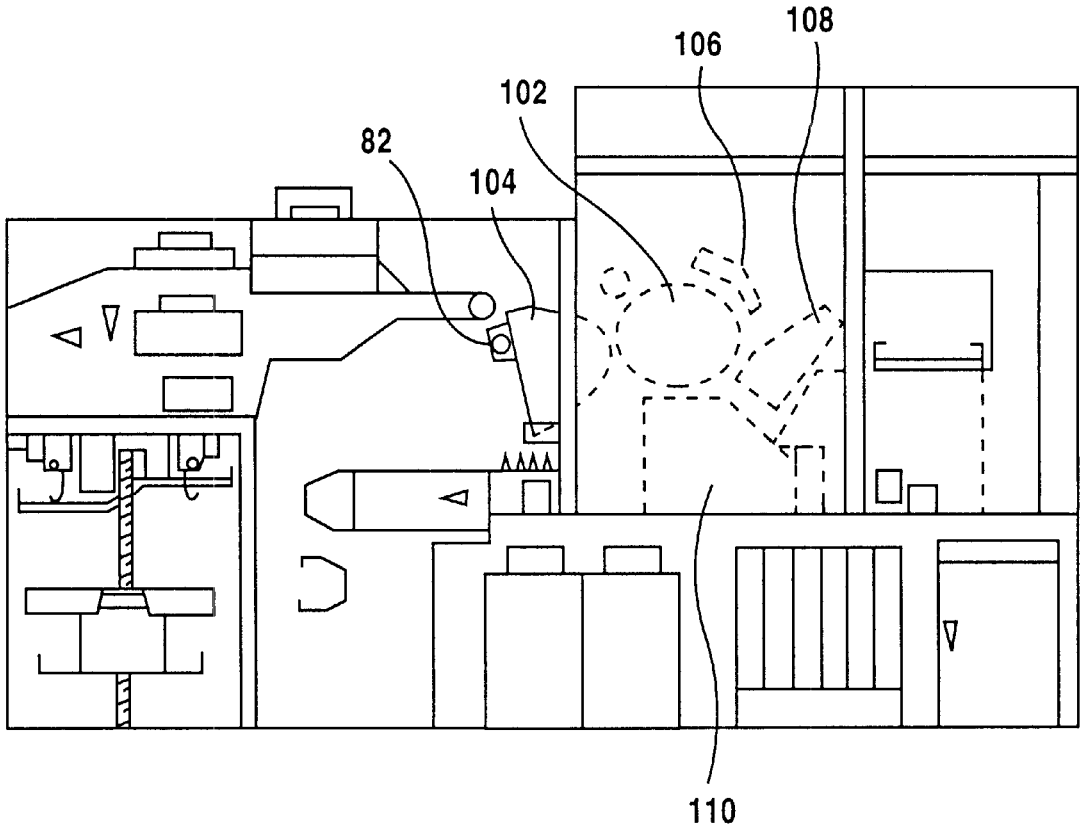
FIG. 7 is a front view of the motor in the device shown in FIG. 5.
Figure 8:
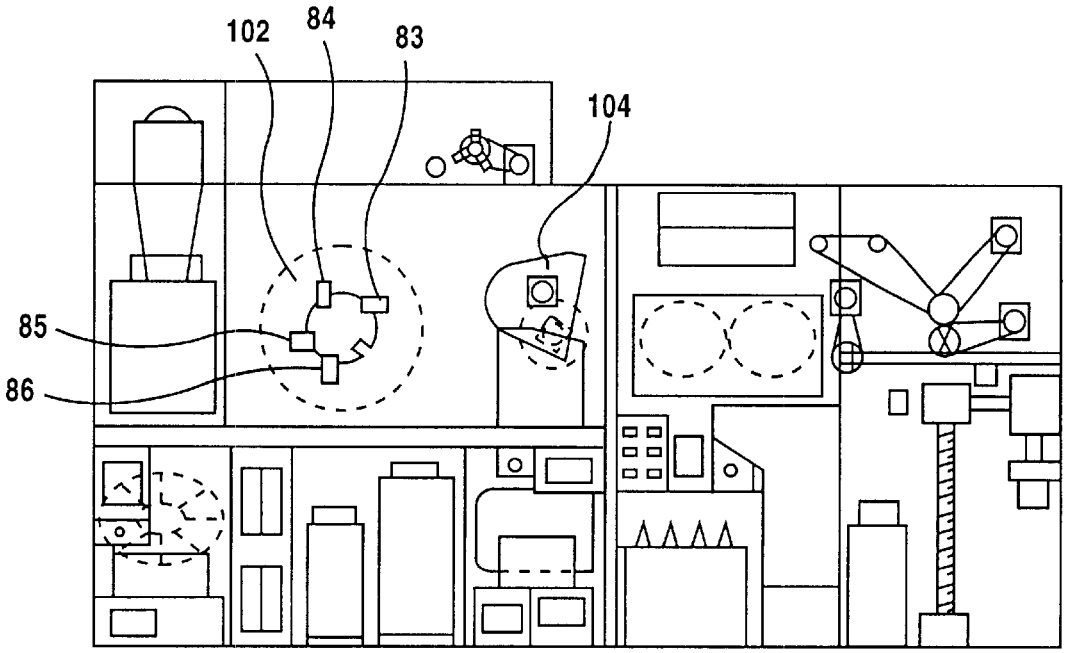
FIG. 8 is a rear view of a sensor and a photo-interrupter in the device shown in FIG. 5.
Figure 10:
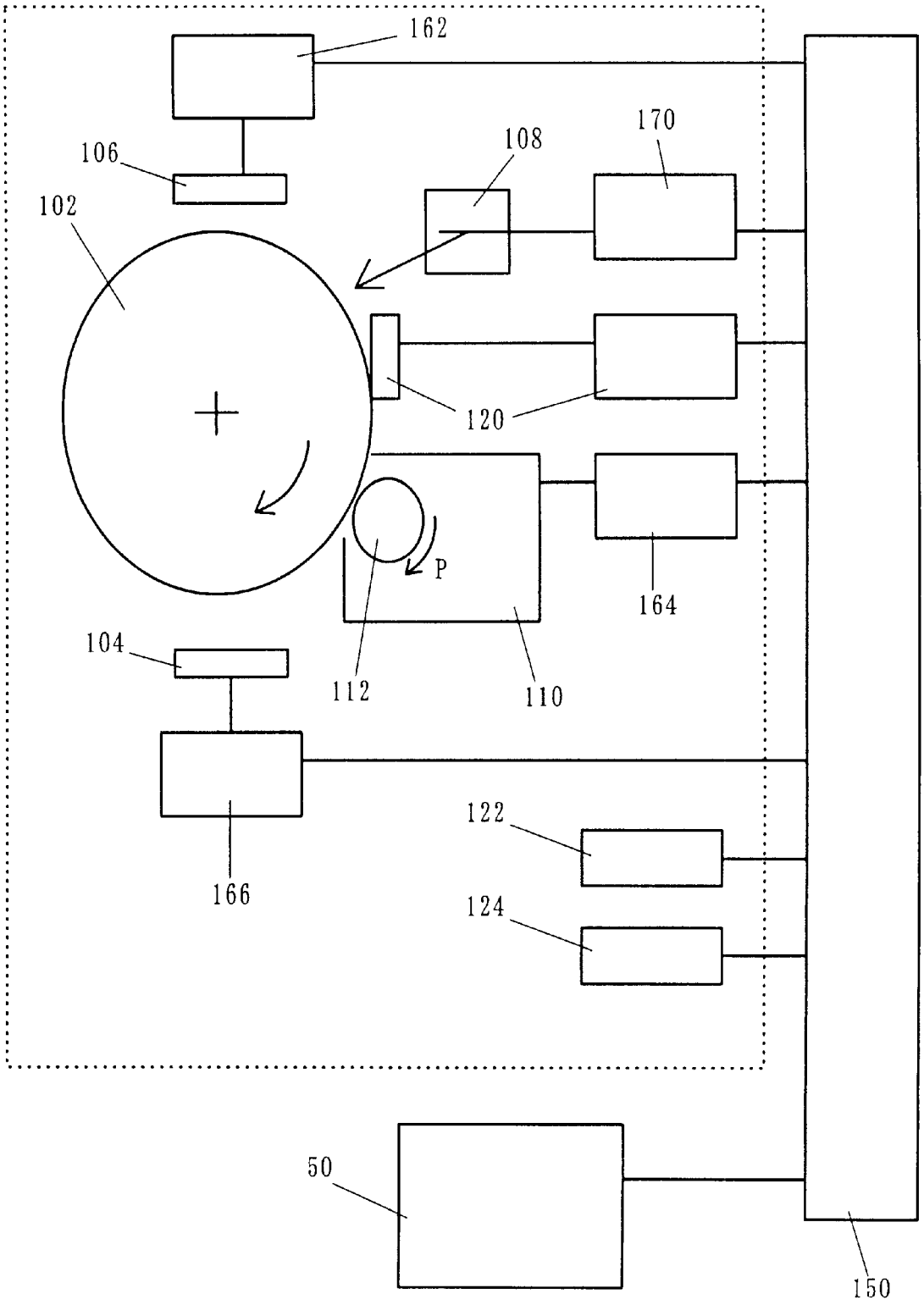
FIG. 10 is a partial block diagram of the printer mechanical part shown in FIG. 1.

The control part 20 in FIGS. 7 and 8 is set so that it may considers abnormal a case where no outputs from the separation tab set position detector 84 are generated within 1 sec after the pinch-roller adhesion motor 82 is started. Referring to FIG. 9, the evaluation method of this embodiment makes the control part 20 consider t1 that is 1 sec or longer, to be abnormal and evaluate t1 that is less than 1 sec, to be normal in the normal mode. FIG. 9 is a timing chart for detecting that something is wrong with the pinch-roller adhesion motor 82 and/or detector 83 etc., but is usually used to detect that something is wrong with the pinch-roller adhesion motor 82 (and its engagement with another component). Illustrated t1 is expected to be about 260 ms if normal, and is classified in the maintenance mode into three groups of "normal state", "deteriorated state", and "abnormal state" which are assigned "shorter than 630 ms", "630 ms through 1 sec" and "longer than 1 sec", respectively. The control part 20 evaluates the deteriorated state to be normal in the normal mode, and to be abnormal in the maintenance mode.

The control part 20 terminates and then reactivates the pinch-roller adhesion motor 82 after detecting the separation tab set position. The control part 20 is also set so that it considers abnormal a case where no outputs are generated from either the pinch-roller position down 1 or 2 detector within 1 sec which is determined by an output of a paper thickness indicator (not shown). Referring to FIG. 9, the evaluation method of this embodiment makes the control part 20 consider t2 or t3 that is 1 sec or longer, to be abnormal, and t2 and t3 that are both less than 1 sec, to be normal in the normal mode. However, t2 shown in FIG. 9 is expected to be about 280 ms in the normal state, and thus is classified in the maintenance mode into three groups of "normal state", "deteriorated state", and "abnormal state" which are respectively assigned "shorter than 640 ms", "640 ms through 1 sec", and "longer than 1 sec". The control part 20 considers the deteriorated state to be normal in the normal mode, and to be abnormal in the maintenance mode. Similarly, t3 shown in FIG. 9 is expected to be about 320 ms in the normal state, and thus is classified in the maintenance mode into three groups of "normal state", "deteriorated state", and "abnormal state" which are respectively assigned "shorter than 660 ms", "660 ms through 1 sec", and "longer than 1 sec". The control part 20 considers the deteriorated state to be normal in the normal mode, and to be abnormal in the maintenance mode.

The control part 20 terminates and then reactivates the pinch-roller adhesion motor 82 after detecting the pinch-roller position down 1 or 2. The control part 20 is also set so that it considers abnormal a case where no outputs are generated from the pinch-roller UP position detector 83 within 2 sec after reactivating the pinch-roller adhesion motor 82. Referring to FIG. 9, the evaluation method of this embodiment makes the control part 20 consider t4 that is 2 sec or longer, to be abnormal, and t4 that is 2 sec or shorter, to be normal in the normal mode. However, t4 shown in FIG. 9 is expected to be about 940 ms in the normal state, and thus is classified in the maintenance mode into three groups of "normal state", "deteriorated state", and "abnormal state" which are respectively assigned "shorter than 1470 ms", "1470 ms through 2 sec", and "longer than 2 sec". The control part 20 evaluates the deteriorated state to be normal in the normal mode, and to be abnormal in the maintenance mode.

The evaluation method of this embodiment may be realized using FIG. 4, and a description thereof will be omitted.

Next follows a description of the inventive evaluation method applied to the print system. The conventional maintenance inspection cannot recognize the image quality quantitatively. The deteriorated image quality includes white printing (i.e., a phenomenon that a portion that should be colored in black becomes white), white bands, entirely pale or dark color, blotching, being unable to obtain the image quality corresponding to a desired print mode (for example, the image quality is coarse even in a fine mode), black blobs on a paper, etc. It is also difficult for the conventional inspection with eyes to identify a component that becomes deteriorated or broken down. The print operation is composed of a plurality of processes including charging, exposure, development, transferring with a photosensitive drum, and the image quality is a synthetic quality result of these processes.

The present invention has addressed, as electric parameters that affect the image quality, a photosensitive-drum surface potential, exposure power, development magnetic-brush bias voltage, and transfer current which depend upon the printer 100's environment (such as temperature and humidity), and has intended to improve the entire image quality by changing these parameters singularly or in combination and evaluating the resultant image quality. Concretely, this embodiment judges, as a quality guarantee test at the time of manufacturing and/or maintenance inspection, whether the printer 100 may operate properly, while changing singularly or in combination up and down within a printable range, standard (or current) values of the above electric parameters which activate the printer 100.

With reference to FIGS. 5, 7, 8 and 10, a brief description will be given of the photosensitive-drum surface potential, exposure power, development magnetic-brush bias voltage, and transfer current.

The printer 100 includes photosensitive drum 102, transfer unit 104, pre-charger 106, optical part 108, and developer 110. A printing paper passes between the photosensitive drum 102 and the transfer unit 104. The pre-charger (e.g., corona charger) 106 charges the photosensitive drum 102. The photosensitive drum 102 is made, for example, of an aluminum drum onto which an about 20 im thickness of function-separation type organic photosensitive member is applied. The photosensitive drum 102 has a diameter, for example, of 30 mm and rotates in an arrow direction at a rotational speed of 70 mm/s. The corona charger is made, for example, of a Scorotron charger, and charges uniformly the photosensitive drum 102 surface by about −500 V. The corona charger 106 has a high-voltage wire (not shown) that may apply 8 through 12 kV, and applies a potential by corona discharge onto a grid screen ("grid") spaced from this wire. The grid is connected directly or close to the photosensitive drum 102, while the grid voltage and the drum surface potential are controlled to be equal. Surface-potential detector 120 which may employ any structure known in the art detects the surface potential of the photosensitive drum 102.

Next, the optical part 108 exposes the uniformly charged photosensitive drum 102 by a laser and forms a latent image with −50 through −100 V on the photosensitive drum 102. The exposure power thus determines the latent image quality.

Then, the latent image is developed by the developer 110 having development roll 112, and thereby converted into a toner image on the photosensitive drum 102. The development roll 112 rotates in arrow direction P in FIG. 10, and a fixed magnetic pole member having a plurality of magnetic poles, and a sleeve that rotates around the magnetic pole member. This sleeve rotates in the arrow direction P as illustrated, and feeds the development agent to a development area that faces the photosensitive drum 102. Toner retains an electric charge opposite to the electric charge pattern on the photosensitive drum 102, and is absorbed by the electrostatic force onto the photosensitive drum 102 surface for development. A bias voltage that is applied to the magnetic brush formed on the development roll 112 adjusts charging to toner, and toner concentration.

The transfer unit 104 faces the photosensitive drum 102 via the printing-paper feed path. The transfer unit 104 adopts a known transfer unit having a corona (discharge) wire, and applies the transfer current to a printing paper using the corona discharge. The current flowing from the corona (transfer) wire to the photosensitive drum 102 is transfer current. When a printing paper reaches the transfer position, the transfer unit 104 applies a voltage to the corolla wire 282 from a surface opposite to the printed surface of the printing paper. As a consequence, the toner image on the photosensitive drum 102 surface is transferred by absorbing and attaching the toner image onto the printing paper.

Figure 11:
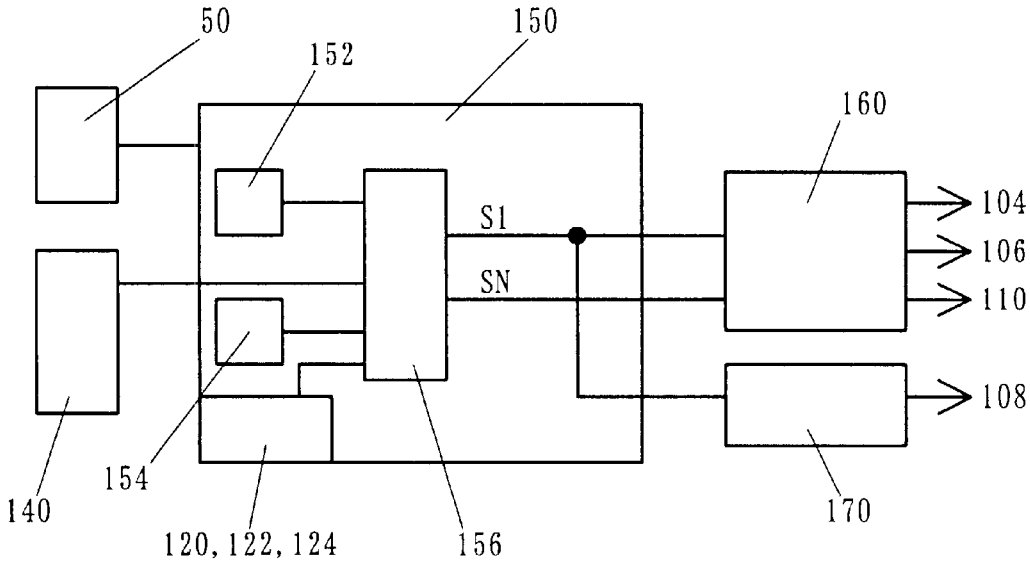
FIG. 11 is a detailed block diagram of a control part shown in FIG. 1.

A description will be given of a margin test of the present invention regarding a controls over the photosensitive-drum surface potential, exposure power, development magnetic brush bias voltage, and transfer current. These are controlled by mechanical-part control circuit 150 that will be described below. Hereupon, the control part 20 shown in FIG. 1 specifically includes, as shown in FIG. 11, controller 140 and mechanical-part control circuit 150.

The controller 140 is connected via an interface (not shown) which is provided at the rear surface etc. of the printer 100, to a computer, a network, such as a LAN, and other external devices (not shown) (hereinafter simply "host computer").

The controller 140 converts print information sent from the host computer into, for example, bit map video data, and send it to the mechanical-part control circuit 150. The controller 140 may employ any structure known in the art, and a description thereof will be omitted.

The mechanical-part control circuit 150 controls high-voltage power unit 160 and exposure power control part 170, and generates a switching signal for them. The switching signal is changed by a selection of a double-side or single-side print unit or by a parameter, such as a regular paper and a thick paper. The mechanical-part control circuit 150 controls other mechanical components (units) in the body, such as a main motor. It is conceivable that the mechanical-part control circuit 150 includes pre-charger control part 162, development magnetic brush bias control part 164, and transfer current control part 166 shown FIG. 10.

The mechanical-part control circuit 150 includes PROM 152 corresponding to the ROM 24, various sensors (120, 122 aid 124), RAM 154 corresponding to RAM 22, and MPU 156. The mechanical-part control circuit 150 is connected to the controller 140. and receives bit map video data (print data) from the controller 140. The display part 50 indicates an operation of the mechanical-part control circuit 150 connected to the display part 50. The display part 50 may be comprised of the mode switch 30 and a touch-key operational panel. The mechanical-part control circuit 150 is connected to a main motor (not shown), the high-voltage power unit 160, and the exposure power control part 170. For illustration purposes, FIG. 11 shows only signal lines that which supply control signals (s1 through sN), and any desired number of signal lines may be provided depending upon the number of parameters to be changed (i.e., controlled). FIG. 11 generalizes such other signal lines as sN.

The PROM 152 stores, as a program, an instruction to each unit and set data, and necessary data is loaded onto and executed by the RAM 154. The MPU 156 operates in accordance with the program stored in the PROM 152. Various sensors include or are connected to outputs of surface-potential detector 120, temperature sensor 122, and hygrometer sensor 124, and their outputs are supplied to the MPU 156 in any event. Those sensors such as the temperature sensor 122 and the hygrometer sensor 124 may employ any structure known in the art, and a description of their structures and operations will be omitted.

The MPU 156 receives print data and resultant outputs from the various sensors. including information such as the paper size (width), paper type (such as a thick paper, a regular paper, or a printing paper made by other manufacturers), resolution etc., and generates a variety of control signals in accordance with the program stored in the PROM 152. More specifically, the MPU 156 controls logic for each signal line, thereby controlling a print operation.

The signal s1 switches a speed of the main motor (not shown), a voltage for the pre-charger in the high-voltage power unit 160, and a resolution in the optical part 108. The signal s1 is branched in the mechanical-part control circuit 150, and output to each unit. The signal sN includes a switch signal to regulate the high-voltage power unit 160's transfer current and the development magnetic brush's bias voltage.

For example, (the pre-charger control part 162 in) the high-voltage power unit 160 in response to the signal s1 switches the voltage in the pre-charger 106. The pre-charger control part 162 controls the grid and photosensitive drum 102 so that their surface potentials are equal to each other. For example, in an attempt to set the grid and the photosensitive drum 102 to 500 V, the control part controls the voltage to be applied to the wire within the range from 8 to 12 kV. However, the dirty grid and other reasons often prevent the grid and the drum surface potential from being equal to each other. For example, even when the grid is 500 V, the drum surface potential may possibly be 400 V. In this case, the mechanical-part control circuit 150 controls the pre-charger control part 162 so that the drum surface potential becomes 500 V.

The exposure power control part 170 controls, using a clock and a counter (not shown), a laser emitting time in response to the signal s1 (so that the laser emitting time becomes the time set by the clock x the control signal s1).

The printer 100 of the present invention advantageously has a print mode which may set one or all of the drum surface potential, the exposure power, the development bias voltage, and the transfer current, to printable upper and/or lower limits.

Figure 12:
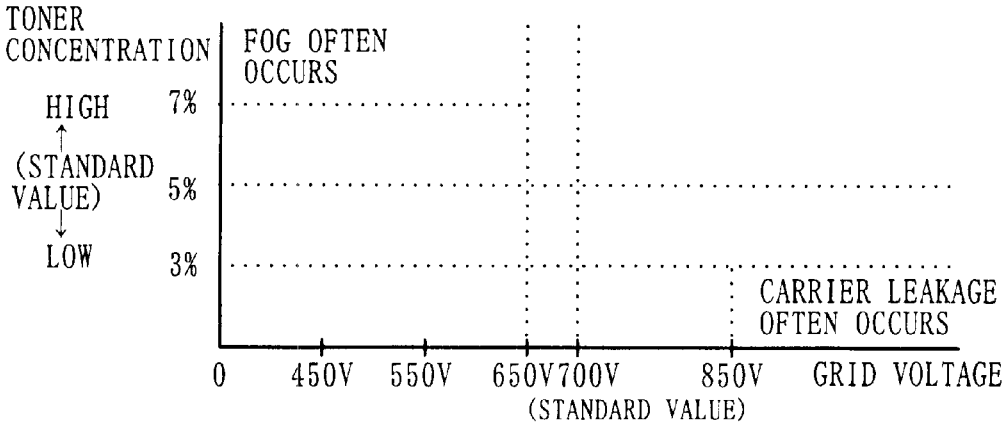
FIG. 12 is a relationship between a grid voltage and toner concentration that affect the print quality.

A description will be given of the evaluation method of the present invention applied to the printer 100, with reference to FIG. 12. FIG. 12 is the image quality depending upon a relationship between the grid voltage and the toner concentration, and allows the current print status (i.e., margin) to be confirmed in FIG. 12 by adjusting the grid voltage and the toner concentration. For example, suppose that the development carrier is adhered to a printed surface when the drum surface potential is set to the upper limit and the exposure power, the development bias, and the transfer current are set to the current values. That is, when the carrier that is black powder is adhered to the printing paper surface, graining the surface and/or blanching a portion that should be originally colored in black (while this state is referred to as "carrier leakage" in FIG. 12), a gap between the developer 110 and the photosensitive drum 102 is not presumably proper and may become an inspection object for maintenance purposes. Similarly, when a portion that is not printed and thus should become white becomes gray or black when the drum surface potential is set to the lower limit and other set values are set to the current values (although this printing state is referred to as "fog" in FIG. 12), the abnormally deteriorated development agent or unusual toner concentration are presumably causative and may become an object for maintenance inspections.

Figure 13:
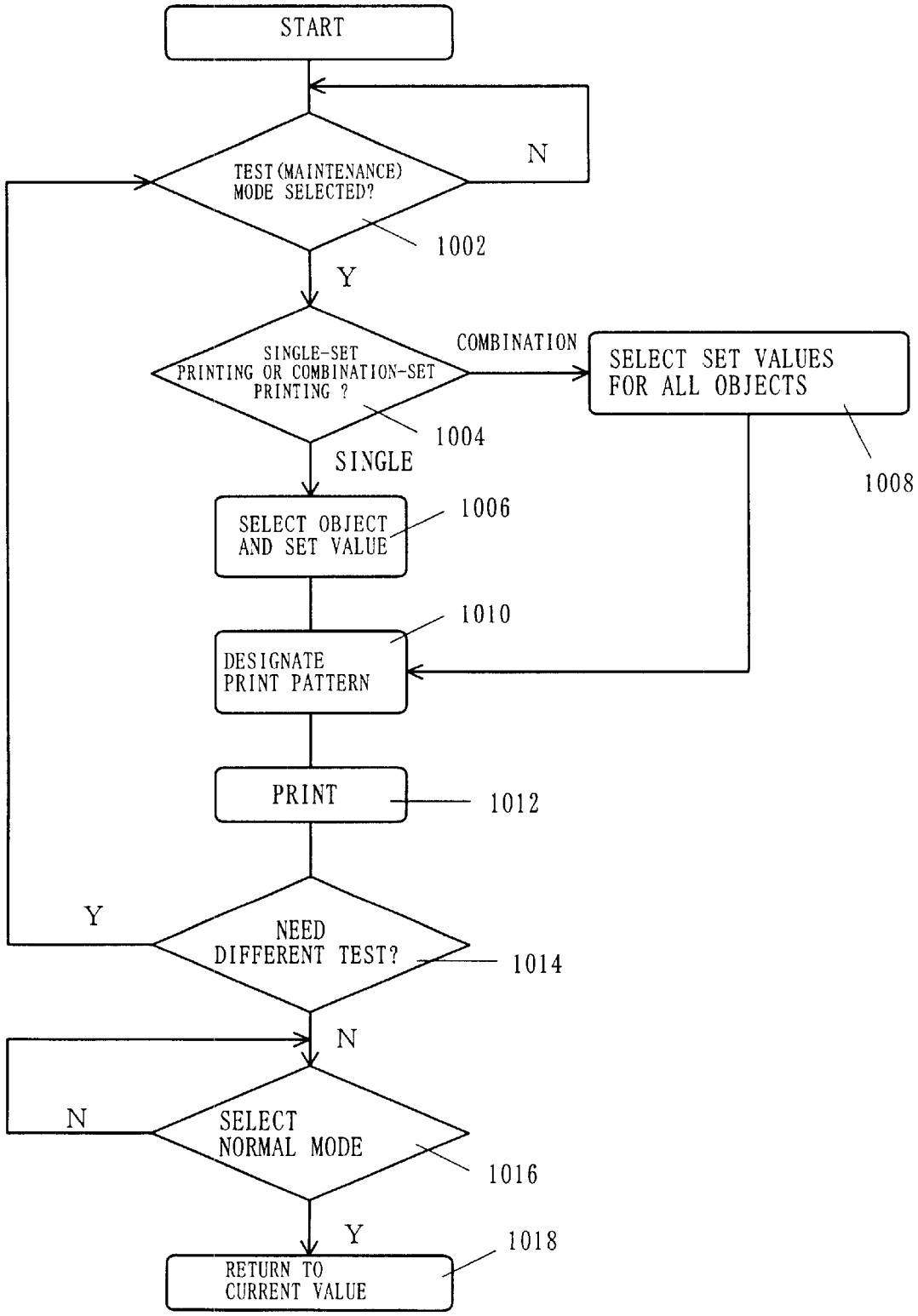
FIG. 13 is an exemplified flowchart of an evaluation method of the present invention.
Figure 14:
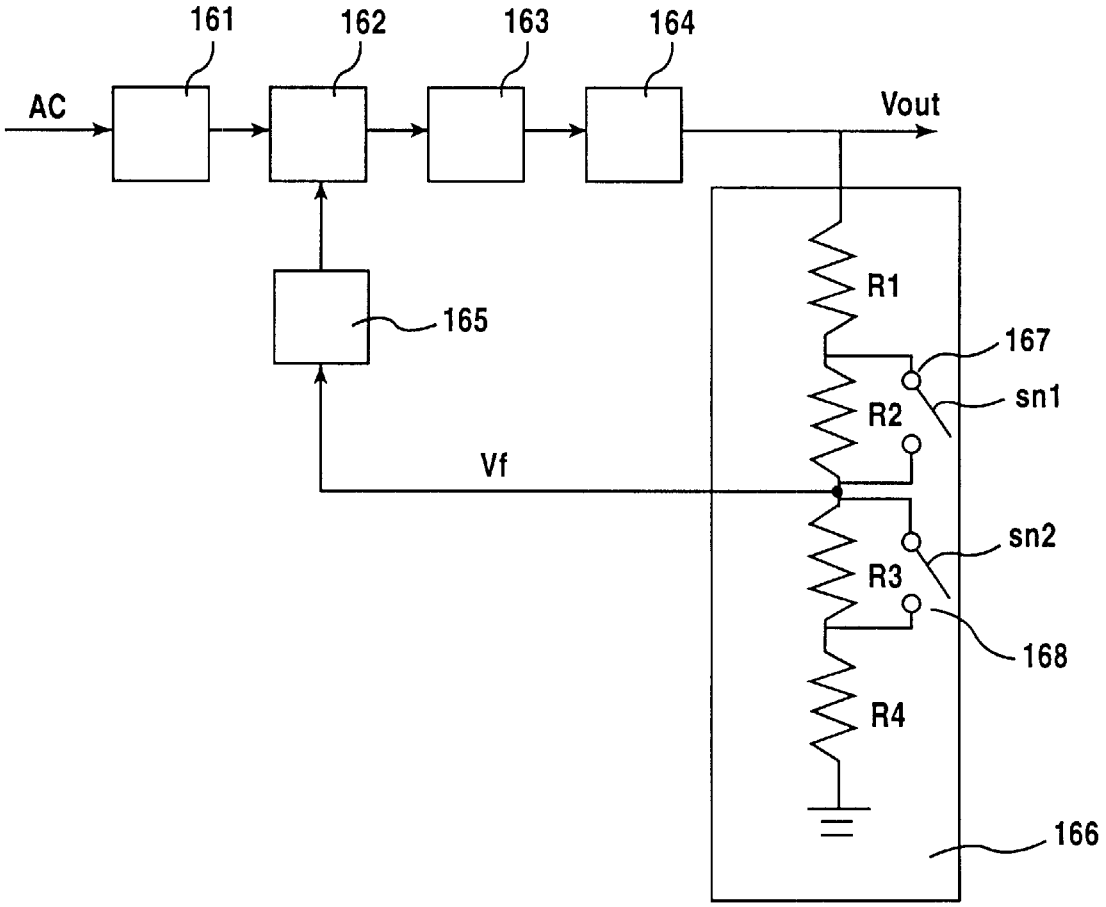
FIG. 14 is a block diagram showing an exemplified high-voltage power unit shown in FIG. 11.

Next follows a description of the evaluation method of the present invention with reference to FIG. 13. The (MPU 156 in the) mechanical-part control circuit 150 confirms whether the operational mode is transferred to the test (or maintenance) mode by switching at the mode switch 30 or a key input to the operational panel comprising the mode switch 30 and the display part 50 (step 1002). When the test mode is set, the display part 50 then prompts a user to select either a single-set or combination-set printing. Then, the mechanical-part control circuit 150 confirms whether either the single-set or combination-set printing is selected (step 1004). Hereupon, the "single-set printing" means a printing where one of the surface potential, the exposure power, the development bias, and the transfer current is set to an upper or lower limit and the other parameters remain to use the current (or standard) set values. The "combination-set printing" means a printing where two or more of them are set to upper and/or lower limits. When the single-set printing is selected, the display part 50 requires the user to select one of the above four objects and an upper or lower value for the selected object. The user, may input that data by any means. For example, the display part 50 may indicate an option of object selection in the order from the surface potential, and then display an option of value selection (i.e., upper or lower limit) for the selected object. Alternatively, the user may input using keys a specific object and a set value. In any event, an object and a set value are consequently selected (step 1006).

For example, the transfer current set to the lower limit would generate a bad transferring or drum's evasion. The transfer current set to the upper limit would generate an uneven potential and dust/discoloration on the drum.

Hereupon, the "bad transferring" means that a necessary amount of a toner image on the photosensitive drum is not transferred to a paper. The "evasion" means that too much toner remains on the photosensitive drum to be completely removed by a cleaning part.

The "uneven potential" means that the photosensitive drum has an uneven potential even after a charge removal or uniform charging is performed for the photosensitive drum. The "dust" means that toner is transferred not to a desired position but to another position. The "discoloration" means that toner is not transferred to a recording paper and no toner is adhered into an image.

When the user selects a combination-set printing at step 1004, the display part 50 prompts the user to select the combination. Similarly, the user may use any input manner. For example, the display part 50 may indicate an option of object selection in the order from the surface potential and then display an option of value selection in the order from the current value.

After the steps 1006 and 1008. the display part 50 prompts the user to designate a print pattern, and the user in response designates the print pattern (step 1010). Alternatively, the display part 50 may indicate a plurality of print-pattern candidates that have been previously stored in the PROM 152 etc., and prompt the user to designate one of the candidates. Optionally. such a step may be omitted by always using a fixed print pattern, or a step for confirming whether the selected value is within the actually printable range may be added. For example, when the current value of the grid voltage is 700 V and 150 V is selected to define the lower limit, i.e., the lower limit is set to 750−150=550 V, a step for confirming whether 550 V is more than the printable lower limit (for example, that is 450 V). Such a step is especially useful when the user arbitrarily sets the upper and lower limits using the operational panel. However, such a step is unnecessary if the MPU 156 automatically executes an operation, and ascertains that the set current value may always be between the printable upper and lower limits. The printable upper and lower limits associated with temperature, humidity etc. may be stored as simulation data in the ROM 24.

Suppose that the surface potential and the development bias voltage are varied to their upper and/or lower limits. When the surface potential and the development bias voltage are set to their lower limits, the toner concentration on the photosensitive drum would decrease and fade print. The surface voltage that is set to the upper limit and the development bias voltage that is set to the lower limit would cause the carrier leakage and/or fog (charge injunction) in addition to the faded print. When the surface voltage is set to the lower limit and the development bias voltage is set to the upper limit, a bad fixation, void, (true) fog, and/or dullness occurs. When the surface voltage and the development bias voltage that are set to their upper limits, the toner concentration on the photosensitive drum increases, generating dullness and void.

The "faded print" means that the small amount of toner on the photosensitive drum lowers the toner concentration on a paper, exhibiting a pale printing. The "carrier leakage" means that the carrier in the developer is pulled out by the photosensitive-drum surface voltage, and adhered to the paper. The "fog (charge injection)" means that the photosenisitive-drum surface voltage is high enough to absorb the toner on the development roller, developing a portion that should not be originally developed on the photosensitive drum and causing an entirely dark printing. The "(true) fog" means that toner's electric charges are pulled onto the photosensitive drum and develop a portion that should not be originally developed, generating an entirely dark printing. As to the phenomenon, the (true) fog is similar to the fog (electric charge injection). The "bad fixation" means that too much toner is transferred onto a paper to fix on the paper even after the paper passes through the fixation device, causing peeling off of the toner. The "void" means that toner transferred onto a paper is popped at the fixation stage, generating an uneven toner surface. The void causes an image of unequal brilliance, and the popped toner spreads and results in collapse. This void is likely to occur in the fixation device that uses a flush fixation using light to fix toner. The "dullness" means that too much toner transferred onto a paper causes an image to be fixed outside a portion that defines the original image, causing a blurred line and a crushed letter.

Next follows a printing (step 1012). The number of prints is preferably, for example, three on end for each kind while all the objects and their set values are printed at an upper left portion of the print pattern, thereby, improving reliability.

If necessity arises, the above operation continues for a different control object (step 1014). When the normal mode is selected after the test (step 1016), a set value for each control object is returned to the current value (step 1018).

The upper and lower values of the drum surface potential, the exposure power, the development bias voltage, and the transfer current may be set by configuring the high-voltage power unit 160 with rectifier 161, switching part 162, transformer 163. DC output part 164, voltage control part 165, and variable DC voltage part 166. The variable DC voltage part 166 includes resistors R1 through R4, analog switches 167 and 168 connected to R2 and R3. As control signals sn1 and sn2 from the MPU 156 opens and closes switches 167 and 168, the output voltage Vout becomes {(R1+R2+R3+R4)/(R3+R4)}Vf when the switches 167 and 168 both turn off, {(R1+R3+R4)/(R3+R4)}Vf when the switch 167 turns on and the switch 168 turns off, and {(R1+R2+R4)/R4}Vf when the switch 167 turns off and the switch 168 turns on. R1 through R4 may be adjusted so that the above values become respectively a standard value, a lower value, and an upper value. The rectifier 161, switching part 162. transformer 163, DC output part 164, and voltage control part 165 may use any structure known in the art, and a description thereof will be omitted.

The PROM 152 has previously stored upper and lower values as simulation data suitable for printer's environment (such as temperature and humidity), and the MPU 156 may preferably calculate the optimal upper and lower values using such data. Optionally, the upper and lower values may be arbitrarily set from the input means such as the operational panel. Then, the display part 50 and/or all alarm (not shown) may alarm by indication or sound in response to an input which exceeds the printable upper or lower limit.

The present invention enables a user to arbitrarily select one or more the above drum surface potential, the exposure power, the development bias voltage, and the transfer current, by means of the display part 50 etc. The printing under such dividable process conditions facilitates a margin confirmation and preventive maintenance. The image quality is commonly composed of a plurality of processes, and the prior art image-result inspection with eyes cannot identify a deteriorated component. On the other hand, the inventive printing may easily identify the deteriorated component by using the electric parameters singularly or in combination. The upper and lower values that are quantified improve simplicity and reliability in comparison with the conventional inspection with eyes.

Further, the present invention is not limited to these preferred embodiments, but various variations and modifications may be made without departing from the scope of the present invention.

A printer of a first aspect of the present invention may quantitatively recognize deterioration of a component that has not been recognized in the prior art, and predict a possible drawback that would happen in the near future by evaluating the deteriorated state to be abnormal. A printer of a second aspect of the present invention may print while setting one or more of those electric parameters which include photosensitive drum's surface potential, optical part's exposure power, developer's bias voltage, and transfer unit's transfer current, to printable upper and/or lower limits, thereby confirming the image quality margin easily and improving the reliability on a printed result. The image quality is commonly composed of a plurality of processes, and the prior art image-result inspection with eyes cannot identify a deteriorated component. On the other hand, this invention may easily identify the deteriorated component by using the electric parameters singularly or in combination. The upper and lower limits that are quantified improve simplicity and reliability in comparison with the conventional inspection with eyes. Similarly the evaluation method of the present invention enables printing by setting the electric parameters to upper and/or lower limits, thereby confirming the image quality margin easily and improving the reliability on a printed result.

What is claimed is:

1. A printer comprising:

a mechanical part which feeds a printing paper in order to print predetermined information on the printing paper;

a mode switch which switches between plural modes; and a control part which controls said mechanical part and determines quantitatively, in each mode in which state among normal, deteriorated, and abnormal states each component in said mechanical part is located, wherein said mode switch switches an operation of said mechanical part between a normal mode and a maintenance mode, wherein said control part considers the normal and deteriorated states to be normal and the abnormal state to be abnormal when said mode switch is set to the normal mode, and wherein said control part considers the normal state to be normal and the deteriorated and abnormal states to be abnormal when said mode switch is set to the maintenance mode.

2. A printer according to claim 1, further comprising a display part that indicates the normal state, the deteriorated state, and the abnormal state of said mechanical part.

3. A printer according to claim 1, further comprising a display part which indicates a deterioration level when said mechanical part is in the deteriorated state.

4. A printer according to claim 1, further comprising a detection level input part which sets detection values for the normal, deteriorated, and abnormal states.

5. A printer comprising:

a photosensitive body;

a pre-charger which charges said photosensitive body;

an optical part which exposes said charged photosensitive body;

a developer which applied a bias voltage to toner and develops said exposed photosensitive body, forming a toner image with a desired concentration;

a transfer unit which transfers the toner image onto a printing paper by applying a transfer current to the printing paper; and a control part which enables printing by setting to printable upper and lower limits one or more set values among electric parameters including an exposure power in said optical part, the bias voltage in said developer, and the transfer current in said transfer unit.

6. A printer according to claim 5, further comprising an input part that may select an arbitrary combination out of the electric parameters, wherein the electric parameters further include a surface potential in said photosensitive body which is to be combined, when used by said control part, with at least one of the exposure power, the bias voltage, and the transfer current.

7. A printer according to claim 5, further comprising a compensation part which compensates the upper and lower limits in accordance with an environment.

8. A printer according to claim 5, further comprising an input part that may set the set values.

9. A printer according to claim 8, further comprising an alarm part that notices that the set value exceeds the printable upper or lower limit.

10. A printer according to claim 5, further comprising a selection part which enables the set values among the electric parameters to be printed on the printing paper.

11. An evaluation method comprising the steps of:

setting a mode used to test a print-quality margin;

setting to an upper or lower value one or more set values among electric parameters including an exposure power in an optical part, a bias voltage in a developer, and a transfer current in a transfer unit; and printing a predetermined pattern in accordance with the set electric parameters.

* * * * *